US012338827B2

(12) United States Patent
Bellobuono et al.

(10) Patent No.: US 12,338,827 B2
(45) Date of Patent: Jun. 24, 2025

(54) COMPRESSOR FOR CO2 CYCLE WITH AT LEAST TWO CASCADE COMPRESSION STAGES FOR ASSURING SUPERCRITICAL CONDITIONS

(71) Applicant: NUOVO PIGNONE TECNOLOGIE SRL, Florence (IT)

(72) Inventors: Ernani Fulvio Bellobuono, Florence (IT); Lorenzo Toni, Florence (IT); Angelo Grimaldi, Florence (IT); Emanuele Rizzo, Florence (IT); Roberto Valente, Florence (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 0 days.

(21) Appl. No.: 18/253,638

(22) PCT Filed: Nov. 24, 2021

(86) PCT No.: PCT/EP2021/025459
§ 371 (c)(1),
(2) Date: May 19, 2023

(87) PCT Pub. No.: WO2022/111852
PCT Pub. Date: Jun. 2, 2022

(65) Prior Publication Data

US 2024/0011493 A1 Jan. 11, 2024

(30) Foreign Application Priority Data

Nov. 27, 2020 (IT) ..... 102020000028685

(51) Int. Cl.
*F04D 17/12* (2006.01)
*F04D 17/02* (2006.01)
(Continued)

(52) U.S. Cl.
CPC ..... *F04D 17/12* (2013.01); *F04D 17/02* (2013.01); *F04D 25/16* (2013.01); *F04D 29/284* (2013.01); *F04D 29/582* (2013.01)

(58) Field of Classification Search
CPC ..... F04D 17/025; F04D 17/12; F04D 17/122; F04D 1/025; F04D 29/2277
See application file for complete search history.

(56) References Cited

U.S. PATENT DOCUMENTS 3,504,986 A * 4/1970 Jackson ..... F04D 15/0011 415/28
3,958,905 A 5/1976 Wood
(Continued)

FOREIGN PATENT DOCUMENTS

CA 2658412 A1 9/2010
JP 2012 145092 A 8/2012
(Continued)

*Primary Examiner* — Woody A Lee, Jr.
*Assistant Examiner* — Cameron A Corday
(74) *Attorney, Agent, or Firm* — Paul Frank + Collins P.C.

(57) ABSTRACT

The compressor is used for processing a CO2 flow; a first compressor stage has a first row of blades with a first number of blades and a second compressor stage, downstream the first compressor stage, has a second row of blades with a second number of blades; the number of blades of the first compressor stage is less than the number of blades of the second compressor stage; there is an annular gap between the first row of blades and the second row of blades; the first compression stage (200) is designed so to assure that the CO2 flow is in supercritical condition, preferably close to CO2 critical point, at its outlet, and so that the second compressor stage process CO2 in supercritical condition.

9 Claims, 5 Drawing Sheets

(51) Int. Cl.

| | |
|---|---|
| ***F04D 25/16*** | (2006.01) |
| ***F04D 29/28*** | (2006.01) |
| ***F04D 29/58*** | (2006.01) |

(56) References Cited

U.S. PATENT DOCUMENTS

| | | | | |
|---|---|---|---|---|
| 4,375,937 | A * | 3/1983 | Cooper | F04D 15/00 415/58.4 |
| 6,488,469 | B1 * | 12/2002 | Youssef | F04D 17/122 415/181 |
| 9,982,676 | B2 * | 5/2018 | Eifert | F02C 3/08 |
| 10,480,519 | B2 * | 11/2019 | Bryan | F01D 5/048 |
| 10,787,963 | B2 * | 9/2020 | Amos | F02C 9/18 |
| 11,560,901 | B2 * | 1/2023 | Perez | F25B 1/053 |
| 2007/0204615 | A1 * | 9/2007 | Vrbas | F02B 37/013 60/605.1 |
| 2010/0232953 | A1 * | 9/2010 | Anderson | F02C 3/08 415/199.5 |
| 2012/0272663 | A1 | 11/2012 | Moussa | |
| 2013/0189094 | A1 * | 7/2013 | Nikpour | F04D 19/00 415/206 |
| 2017/0248154 | A1 | 8/2017 | Nakaniwa et al. | |

FOREIGN PATENT DOCUMENTS

| | | | |
|---|---|---|---|
| JP | 5158705 | B2 | 3/2013 |
| JP | 5187609 | B2 | 4/2013 |
| JP | 2016075184 | A | 10/2014 |
| RU | 2675164 | C2 | 12/2018 |
| RU | 2718397 | C2 | 4/2020 |
| RU | 199019 | U1 | 8/2020 |

* cited by examiner

COMPRESSOR FOR CO2 CYCLE WITH AT LEAST TWO CASCADE COMPRESSION STAGES FOR ASSURING SUPERCRITICAL CONDITIONS

TECHNICAL FIELD

The subject-matter disclosed herein relates to a CO2 flow compressor, an CO2 cycle energy generation system and a method for compressing a CO2 flow.

BACKGROUND ART

The European Union, in short EU, has set a long-term goal to cut greenhouse gas emissions by 80-95% by 2050 compared to 1990 levels. The EU 2050 Energy Strategy has therefore serious implications for our energy system and includes new challenges and opportunities. This is a general trend all over the world.

Renewable energies (such as wind and solar) are moving to the center of the energy mix in Europe and raise the question of grid stability in the event of large power output fluctuations. In this context, enhancing the flexibility and the performance of conventional power plants is seen as a good opportunity to both secure the energy grid while reducing their environmental impact.

The sCO2-flex consortium, made up of 10 experienced key players from 5 different EU member states, seeks to increase in the operational flexibility (fast load changes, fast start-ups and shutdowns) and efficiency of existing and future coal and lignite power plants, thus reducing their environmental impacts, in line with EU targets.

Supercritical carbon dioxide (sCO2) is a fluid state of carbon dioxide where it is held at or above its critical temperature and critical pressure. The fluid presents interesting properties that promise substantial improvements in conventional power plant system efficiency.

sCO2 based technology has the potential to meet EU objectives for highly flexible and efficient conventional power plants, while reducing greenhouse gas emissions, residue disposal and also percentage water consumption reduction.

A sCO2 cycle is a closed cycled wherein the fluid is compressed by one or more compressors, heat is introduced into the cycle by a first heat exchanger, the fluid is expanded by one or more expanders and heat is released to the environment through a second heat exchanger. Advantageously, after the expansion and before release of heat to the environment, the fluid passes through a third heat exchanger, i.e. a recovery heat exchanger, to improve the efficiency of the cycle.

SUMMARY

Usually, the first compressor of sCO2 cycle works with a CO2 flow close to critical point. Then, the sCO2 cycle presents reduced work of CO2 compressor, that take advantages from the real gas behavior of the working fluid near the critical point. This feature enhances increasing the overall thermal efficiency of the sCO2 cycle. However, there is large variation of CO2 properties very close to critical point, having technological implications on the design of turbomachinery and heat exchangers.

In particular, the CO2 flow reaches the impeller of the first compressor in a multiphase status because of local acceleration upstream and across compressor impeller leading edge, due to the size of the blade channels of the impeller.

In multiphase region, i.e. under the saturation dome, the speed of sound steeply decreases causing the creation of a sonic region with consequent limitation of compressor operating range.

When a fluid flowing at a given pressure and temperature passes through a constriction, the fluid velocity increases. At the same time, the Venturi effect causes the static pressure, and therefore the density, to decrease at the constriction. This may result in the creation of a sonic region, which limits the compressor operating range.

This problem is heightened in presence of numerous compressor blades, i.e. in presence of numerous constrictions at the compressor inlet due to blade channels.

Due to Venturi effect, a high number of blades at the inlet of the stage increase local flow acceleration that, combined with large departures from the ideal-gas behavior approaching the critical point, could promote phase-change phenomena of the CO2, reducing compressor efficiency and cycle efficiency.

According to one aspect, the subject-matter disclosed herein relates to a compressor arranged to process a CO2 flow, comprising a first compressor stage and a second compressor stage, downstream the first compressor stage; the first compressor stage comprises a first row of rotary blades with a first number of blades and the second compressor stage comprises a second row of rotary blades with a second number of blades; the first number of blades is less than the second number of blades; the CO2 flow is in supercritical condition at the outlet of the first compressor stage.

In particular, the trailing edge of the blades of the first stage discharges a CO2 flow directly to an annular gap and the leading edge of the blades of the second stage receives a CO2 flow directly from the annular gap, CO2 pressure at the first compressor stage trailing edge being equal or higher than saturation pressure plus a predetermined pressure margin, said pressure margin being related to pressure drop inside the second compressor stage.

According to another aspect, the subject-matter disclosed herein relates to an energy generation system based on a supercritical CO2 cycle and including a compressor with at least two cascade compression stages for assuring supercritical conditions, and an annular gap in-between.

According to still another aspect, the subject-matter disclosed herein relates to a method for compressing CO2 flow; a first compression step is used for compressing said CO2 flow to a supercritical condition through a first compressor stage (200) so to generate a supercritical CO2 flow, and a second compression step is used for compressing said supercritical CO2 flow through a second compressor stage (300); the first compression step is such that, at the end of compression, CO2 is close to critical point; between the first compression step and the second compression step there is an isoenthalpic step that maintains substantially constant both total pressure and static pressure, in other words: low losses for total pressure and recovery for static pressure.

BRIEF DESCRIPTION OF THE DRAWINGS

A more complete appreciation of the disclosed embodiments and of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
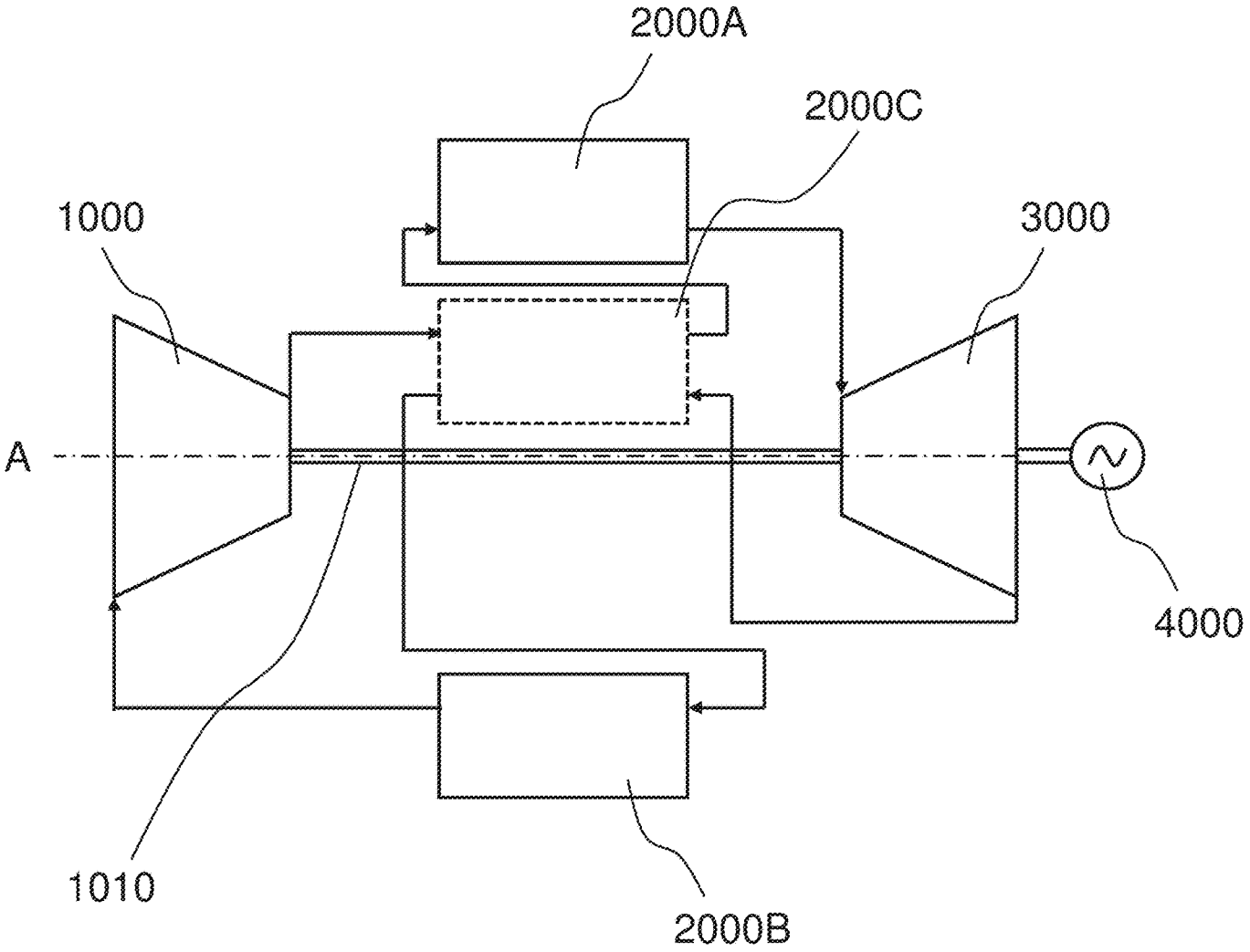
FIG. 1 shows a schematic view of a CO2 system.

The subject matter herein disclosed relates to a compressor and a CO2 system working with a CO2 flow, a method for compressing CO2 flow and a compressor assembly for a CO2 flow cycle.

The efficiency of a gas turbine cycles mainly depends on its pressure ratio (i.e. the ratio between the pressure of the gas flow at the compressor inlet and at the compressor outlet). The maximum pressure is limited due to the cost related to the piping and measurement systems; thereby the minimum pressure of the sCO2 cycle significantly influences the cycle efficiency.

At the same time, the efficiency of the cycle is affected also by the condition of the gas flow, in particular at the inlet of the compressor. In fact, fixed the maximum cycle pressure due to costs, working close to the critical point is advantageous because it allows the compression work to decrease, having as results the improving of cycle efficiency.

However, in a CO2 condition near to critical point, shock waves may occur, limiting the operating region of the compressor and decreasing the efficiency.

In order to overcome this, the compression system disclosed hereby aims to increase cycle efficiency by increasing the pressure of the fluid just enough to allow the compressor impeller to work away from the critical point while maintaining a high pressure ratio.

This is accomplished by having an inducer stage that compresses the fluid with a small pressure ratio and that is designed with a low number of blades to limit the problem of shock waves that causes the collapse of performance. Advantageously, having an inducer stage that has low number of blades avoids the compressor inlet to become the sonic throat of the component.

Reference now will be made in detail to embodiments of the disclosure, an example of which is illustrated in the drawings.

The example is provided by way of explanation of the disclosure, not limitation of the disclosure. In fact, it will be apparent to those skilled in the art that various modifications and variations can be made in the present disclosure without departing from the scope or spirit of the disclosure.

According to one aspect and with reference to FIG. 1, the subject-matter disclosed herein provides an energy generation system based on a supercritical CO2 cycle, i.e. a gas turbine plant working with CO2 as a working fluid mainly in supercritical conditions. Typically, in this type of cycle the working fluid at minimum cycle pressure is in supercritical conditions, but also working fluid in subcritical multiphase conditions with minimum cycle pressure between 80-100% of critical pressure are allowed.

The CO2 system of FIG. 1 comprises two heat exchangers 2000A, 2000B, an expander 3000 and a compressor 1000; advantageously, the compressor and the turbine are driven on the same shaft 1010. The shaft 1010 determines an axis A corresponding to the main development direction of the shaft 1010. As used herein, the terms "axial" and "radial" refers respectively to a direction parallel and perpendicular to the axis A.

Referring to FIG. 1, the CO2 flow flows in a clock-wise direction: is compressed by a compressor 1000, is heated in a first heat exchanger 2000A, is expanded by an expander 3000, is cooled in a second heat exchanger 2000B and finally restarts the cycle. In other words, the CO2 system is a closed-cycle gas turbine.

According to a preferred embodiment, the CO2 system comprises a third heat exchanger 2000C, called also "recuperator"; the third heat exchanger 2000C is suitable for increasing the thermal efficiency of the cycle, receiving the CO2 flow at the outlet of compressor 1000 as a cold fluid and the CO2 flow at the outlet of the expander 3000 as a hot fluid. The recuperator 2000C allows to recover waste heat from expander exhaust CO2 flow and use it to pre-heat the compressed CO2 flow from the compressor 1000 before further heating of compressed CO2 flow in the heat exchanger 2000A, reducing the external heat required.

In the example of FIG. 1, the expander 3000, in particular the shaft 1010 that drives the expander 3000, is coupled with an electric generator 4000, in particular an alternator; alternatively, the expander 3000 may be connected to an external load not shown in figure.

It is to be noted that, depending on the design of the cycle, the number of the machines and heat exchangers may vary, as well as the number of shafts driving the machines.

Figure 2B:
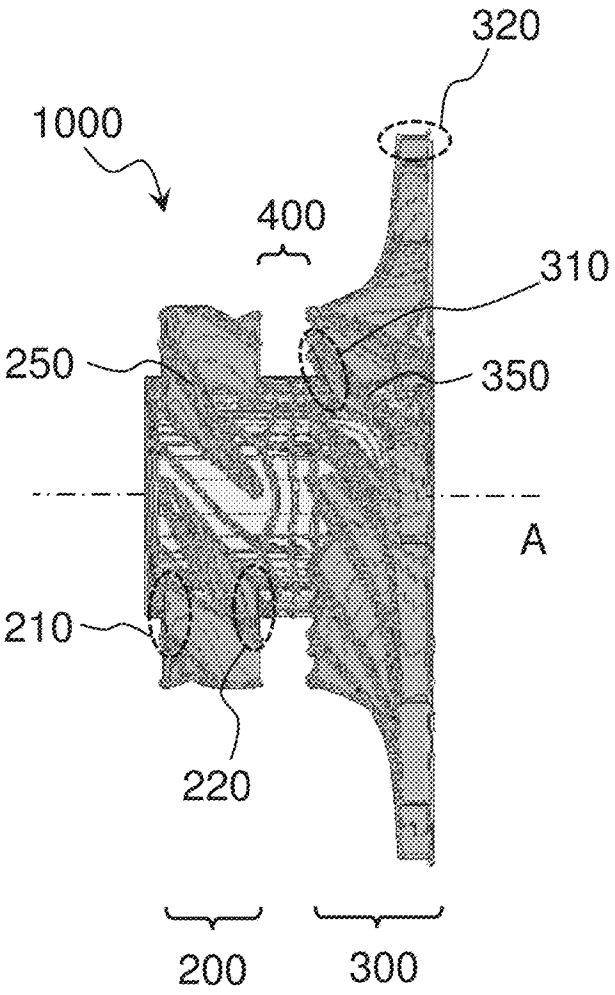
FIG. 2B shows a lateral view of the compressor of FIG. 1.
Figure 2A:
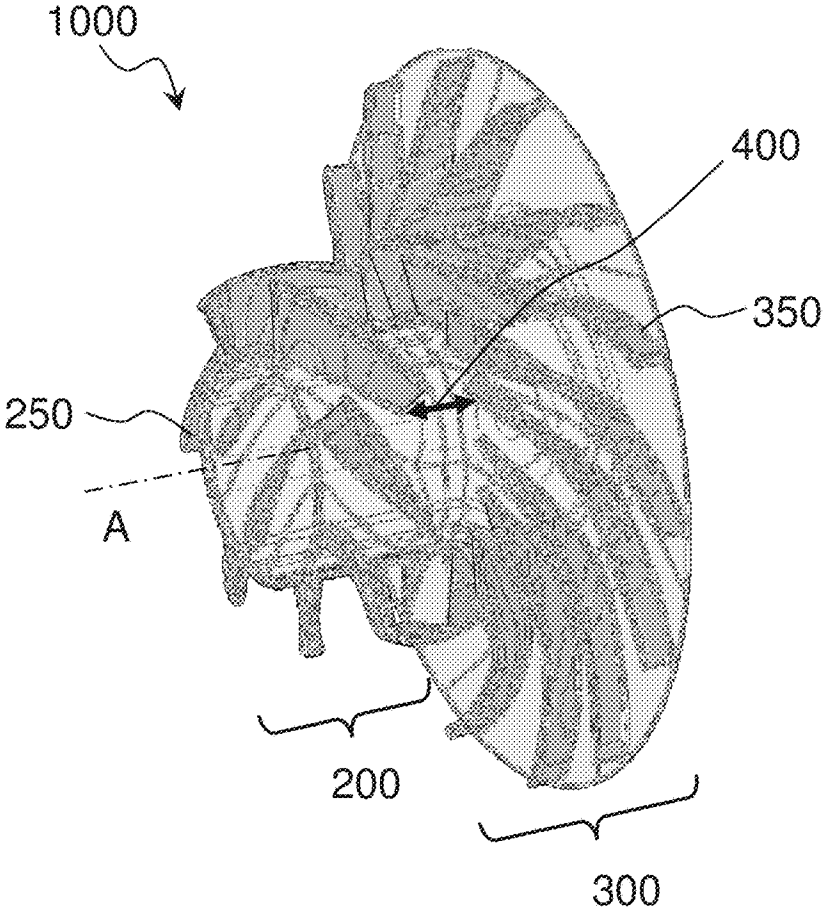
FIG. 2A shows a perspective view of the compressor of FIG. 1.
Figure 3:
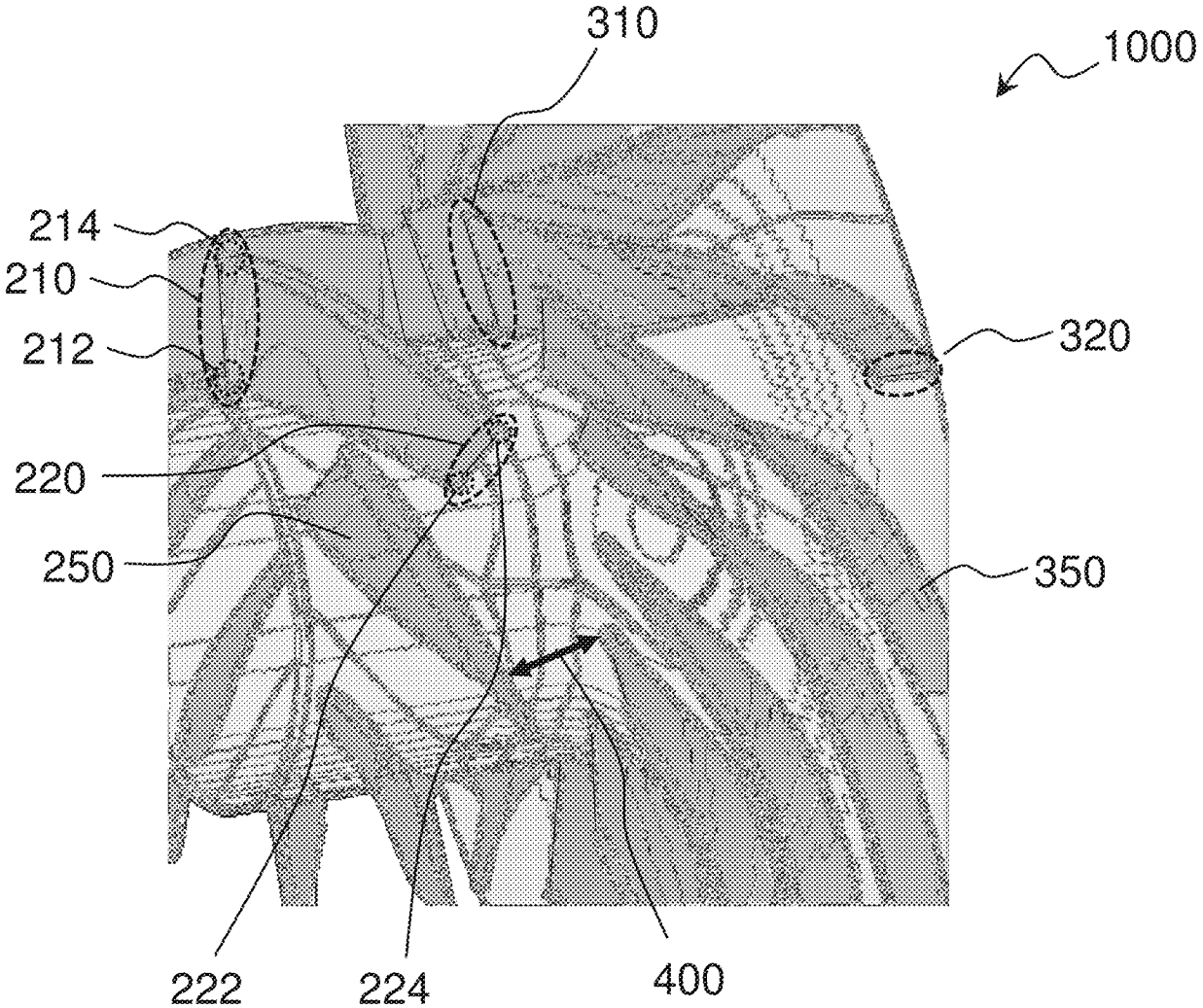
FIG. 3 shows an enlarged view of a portion of FIG. 2A.

According to one aspect and with reference to FIGS. 2 and 3, the subject-matter disclosed herein provides a compressor 1000 to be used for example in a supercritical CO2 system for generating electric energy or for supplying an external load.

The compressor 1000 comprises a first compressor stage 200 and at least a second compressor stage 300 downstream the first compressor stage 200. It is noted that "stage" is here referred to a single row of blades, which can be stationary or rotary. For example, if there is a first row of rotary blades and a second row of stationary blades, the first row of rotary blades is a first stage and the second row of stationary blades is a second stage.

The first compressor stage 200 comprises a first row of rotary blades 250; the second compressor stage 300 comprises a second row of rotary blades 350. Preferably, the first row of blades 250 has an inducer type of blades and the second row of blades 350 has an exducer type of blades. In a preferred embodiment shown in FIGS. 2 and 3, the first number of blades is less than the second number of blades.

Preferably, the first number of blades is about one-half or about one-third the second number of blades. For example, if the second row of blades 350 has a number of blades equal to 18, the number of blades of the first row of blades 250 may be for example 11 or 10 or 9 or 8 or 7 or 6. It is to be noted that the ratio between these two numbers may be any number typically different from an integer number; for example, it may be higher than 1 and lower than 2 or higher than 2 and lower than 3. Therefore, the numbers of blades may be freely chosen independently depending on the mechanical design and performance desired for the two compression stages.

The compressor 100 works typically with a CO2 flow and the first compressor stage 200 provides at the outlet a CO2 flow in supercritical conditions, wherein with "supercritical conditions fluid" is defined a fluid having pressure above its critical point, i.e. having pressure higher than its critical pressure.

In other word, at the outlet of the first compressor stage 200, the CO2 flow has pressure higher than about 7.37 MPa.

Specifically and with reference to FIG. 3, the first compressor stage 200 is arranged to provide a pressure increase between a leading edge 210 with a bottom 212 and a top 214 and a trailing edge 220 with a bottom 222 and a top 224 of the first row of blades 250; such pressure increase being enough for the CO2 flow at the trailing edge 220 to reach supercritical conditions.

Preferably, the CO2 flow has a higher pressure at the trailing edge 220 with respect to the pressure at the leading edge 210. The ratio between the outlet pressure and the inlet pressure of a flow passing through a compressor stage is known as "pressure ratio" or "compression ratio".

Preferably, the leading edge 210 of the first row of blades 250 is in correspondence of an inlet section of the compressor 1000, said inlet section receiving a suction CO2 flow. The CO2 flow is then discharged in correspondence of the trailing edge 220 of the first row of blades 250.

Preferably, the first row of blades 250 has mainly axial development with respect to a direction determined by axis A. Specifically, the axial development of first row of blades 250 is such that the CO2 flow flows mainly in axial direction.

With reference to FIGS. 2 and 3, the compressor 1000 comprises a second compressor stage 300 downstream the first compressor stage 200. Specifically, the second compressor stage 300 is arranged to provide a pressure increase between a leading edge 310 and a trailing edge 320 of the second row of blades 350, such pressure increase being much higher than the pressure increase provided between the leading edge 210 and the trailing edge 220 of the first compressor stage 200.

In other words, the pressure ratio of the first compressor stage 200 is much smaller than the pressure ratio of the second compressor stage 300, i.e. the second compressor stage 300 provides the main pressure ratio of the overall pressure ratio of CO2 cycle. Preferably, the pressure ratio of the first compressor stage 200 is less than 70% of the pressure ratio of the second compressor stage 300 and possibly is more than 3% of the pressure ratio of the second compressor stage 300; for example, the first pressure ratio may be equal to approximately 1.1 and the second pressure ratio may be equal to approximately 1.7.

Figure 4:
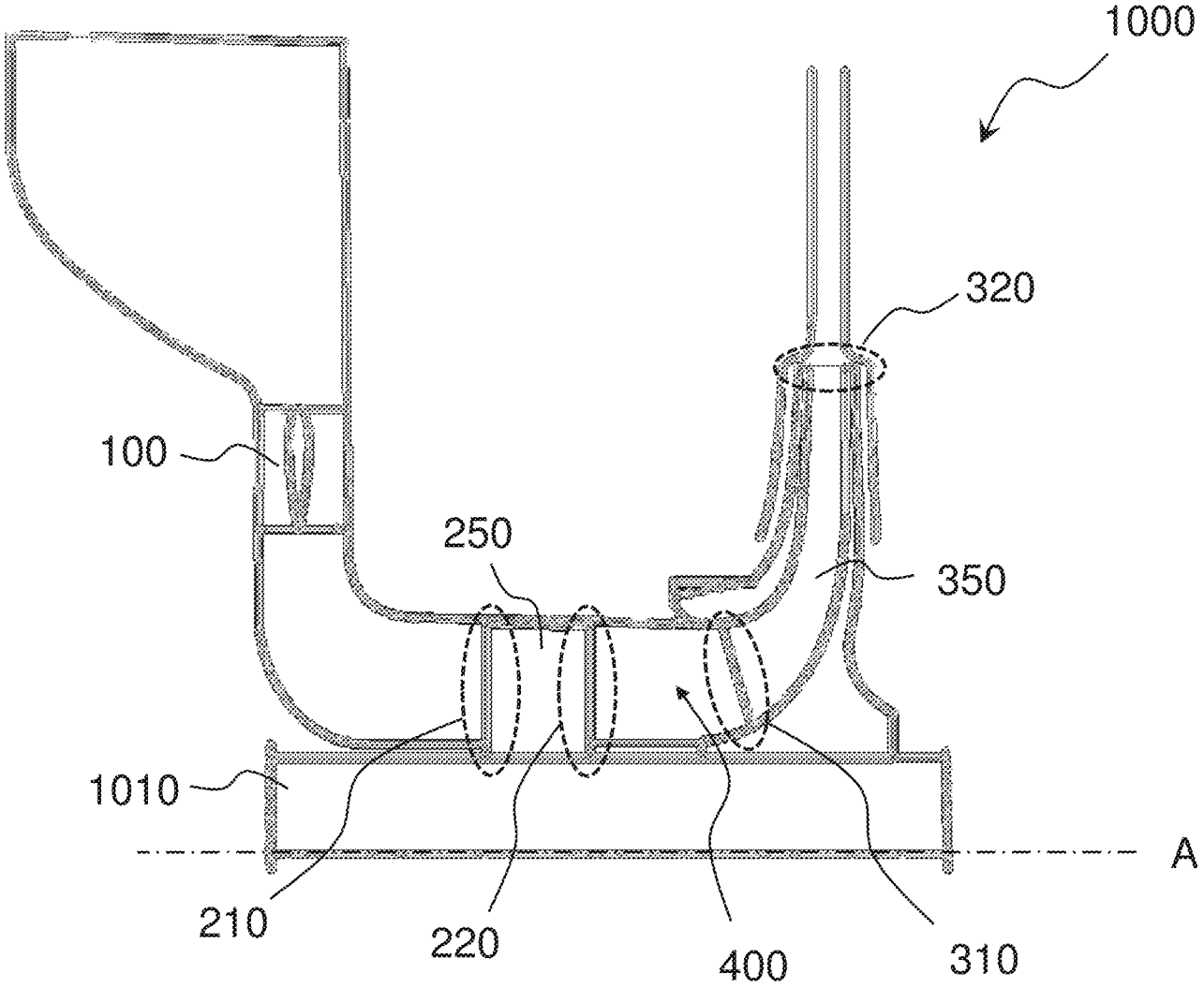
FIG. 4 shows cross-sectional schematic view of a compression system for a CO2 flow cycle.

In a preferred embodiment and with reference to FIGS. 2, 3 and 4, the second compressor stage 300 is a centrifugal compressor stage, having both axial and radial development with respect to a direction determined by axis A. In particular, the flow-path between the leading edge 310 and the trailing edge 320 defines a substantially twisted surface with respect to a direction determined by axis A. Specifically, the leading edge 310 and the trailing edge 320 are located at a different radial distance from axis A.

The first compressor stage 200 (in particular the first row of blades 250) is arranged to provide the CO2 flow directly to the second compressor stage 300 (in particular to the second row of blades 350) without any stationary component in-between, in particular any stator blade, passing through a axial annular gap 400. Specifically, the CO2 flow flows from the first row of blades 250 to the second row of blades 350 without any (substantial) change in pressure (both in static pressure and in total pressure), for example due to stator blades between the trailing edge 220 and the leading edge 310. The Applicant has realized that stator blades between two consecutive rows of rotor blades, which is very common in turbomachines, might seem beneficial; however, in the present case, in order to avoid a system throat, "blade solidity" should be low and the benefit on static pressure recovery would be negligible.

The second row of blades 350 is axially spaced from said first row of blades 250. Specifically, an axial annular gap 400 (developing around axis A) is located between the trailing edge 220 of the first row of blades 250 and the leading edge 310 of the second row of blades 350. In this way, wakes relax so that strong aeromechanic interaction between the two rows is avoided. Preferably, the axial annular gap 400 between the trailing edge 220 and the leading edge 310 has a length between one and two times the height of trailing edge 220 of the first row of blades 250.

With reference to FIGS. 2 and 3, the trailing edge 220 of the first row of blades 250 and the leading edge 310 of the second row of blades 350 may be not aligned along an axial direction. In particular, the leading edge 310 of the second row of blades 350 may have different circumferential positions with respect to the trailing edge 220 of the first row of blades 250 (this arrangement is known as "clocking effect").

In a preferred embodiment, the compressor 1000 comprises a rotor, the first row of blades 250 and the second row of blades 350 being part of the rotor.

With reference to FIG. 4, the rotor is preferably driven by the shaft 1010, so that the first row of blades 250 and the second row of blades 350 rotates at the same angular velocity.

In an alternative embodiment, the compressor 1000 comprises a first rotor and a second rotor, the first row of blades 250 being part of the first rotor and the second row of blades 350 being part of the second rotor.

Advantageously, the first rotor is driven by a first shaft and the second rotor is driven by a second shaft, the first shaft and the second shaft rotating at different angular velocity.

With reference to FIG. 4, the compressor 1000 may further comprise inlet guide vanes 100 upstream the first row of blades 250. Advantageously, the inlet guide vanes 100 comprise a stator row of blades; the stator row of blades can be fixed or can vary blades angle of attack, regulating the CO2 flow sucked by compressor 1000.

According to another aspect, the subject-matter disclosed herein relates to a method for compressing CO2 flow using a compressor for example similar or identical to compressor 1000 described above; such method may be implemented in an energy generation system based on a supercritical CO2 cycle similar or identical to the energy generation system described above.

The method comprises an initial step of compressing CO2 flow to supercritical conditions through a first compressor stage 200 and a following step of compressing supercritical CO2 flow through at least a second compressor stage 300; between the first compression step and the second compression step there is a low-loss isoenthalpic step (in particular inside the axial annular gap) 400 that maintains substantially constant both total pressure and static pressure.

The initial step of compressing CO2 flow to supercritical conditions is such that, at the end of compression, the thermodynamic state point of CO2, on a T-s diagram or equivalent, is located outside the saturation dome, approximately near the CO2 critical point (Pc, Tc).

Figure 5:
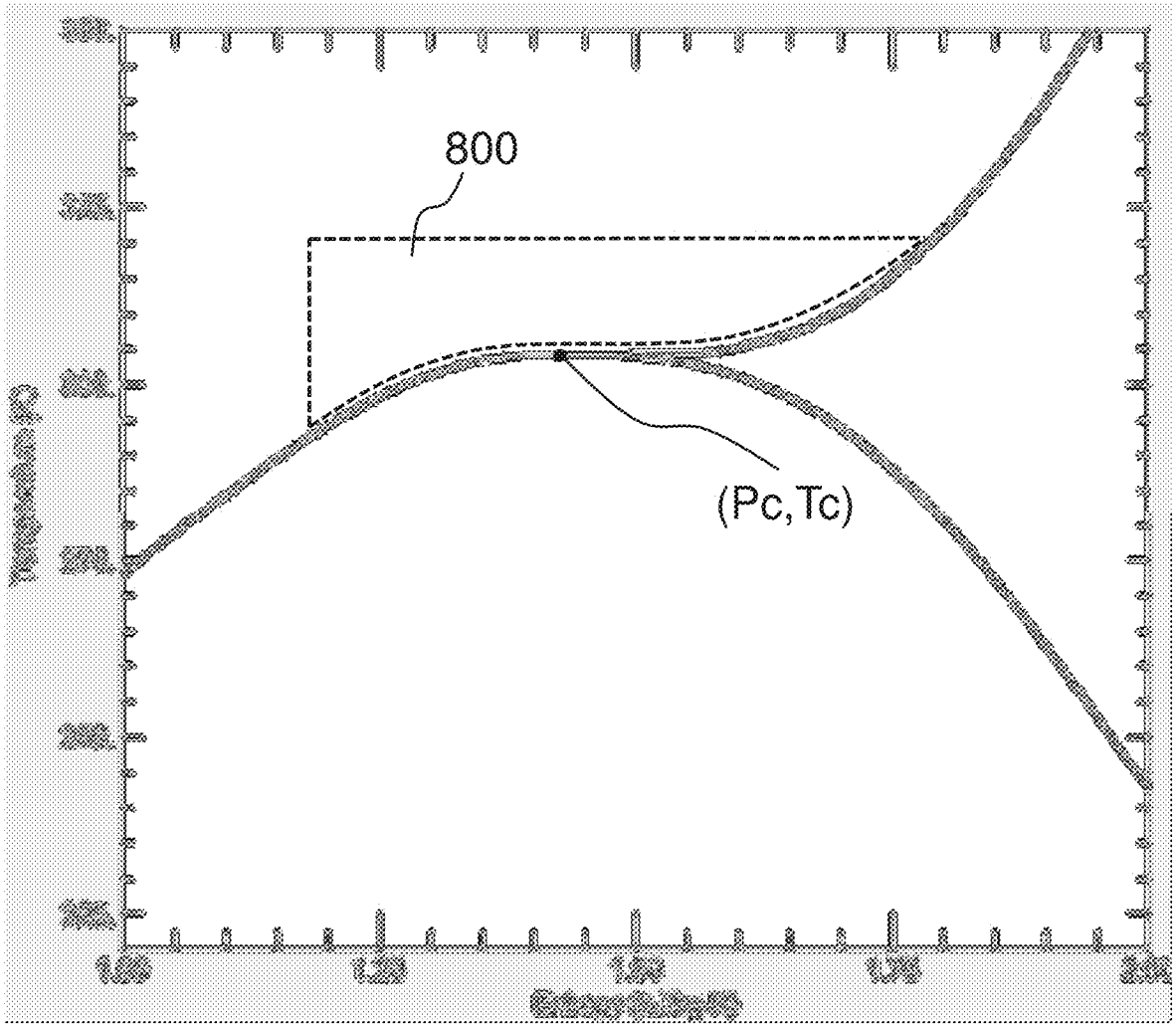
FIG. 5 shows an example of a CO2 compression on a T-s diagram.

With reference to FIG. 5, it is shown a CO2 temperature-entropy diagram wherein is highlighted the CO2 critical point (Pc, Tc) as a black point at the top of the saturation dome. According to the method disclosed herein, after the initial step of compressing CO2 flow, the thermodynamic state point of CO2, i.e. the point which represent the thermodynamic state of the CO2 defined by at least two state variables (for example temperature and pressure), is located outside the saturation dome, in particular around the highlighted area 800 above the CO2 critical point (Pc, Tc).

In a preferred embodiment, the pressure at the outlet of the first compressor stage 200 is equal or higher than saturation pressure plus a predetermined pressure margin, said pressure margin being related to pressure drop inside the second compressor stage 300.

It has to be noted that the initial step of compressing CO2 flow to supercritical conditions can be followed by one or more following steps of compressing supercritical CO2 flow; preferably, the initial step of compressing CO2 flow has a pressure ratio much smaller than each following step.

According to another aspect, the subject-matter disclosed herein relates to compressor arranged to process a CO2 flow comprising: a first rotating compressor stage comprising a first row of inducer blades, said inducer blades extending mainly axially, having a leading edge (210) and a trailing edge (220); a second rotating compressor stage comprising a second row of exducer blades extending mainly axially or mainly radially or both axially and radially, having a leading edge (310) and a trailing edge (320);

an axial annular gap 400 between the first rotating compressor stage and the second rotating compressor stage.

In a preferred embodiment, the inducer trailing edge (220) discharge a CO2 flow directly to the axial annular gap 400 and the exducer leading edge (310) receive a CO2 flow directly from the axial annular gap 400. Preferably, the CO2 flow pressure at the inducer trailing edge (220) is higher than the CO2 flow pressure at the inducer leading edge (210). In particular, the CO2 flow pressure at the trailing edge (220) is equal or higher than saturation pressure plus a predetermined pressure margin, said pressure margin being related to pressure drop inside the second rotary compressor stage.

The above-mentioned pressure margin aims at avoiding that saturation conditions are reached by the CO2 flow inside the second compressor stage. Theoretically, there is no pressure drop within a compressor stage. However, in practice, there may be some pressure drop shortly after the leading edge (310) of the second row of exducer blades; the regions mostly at risk from this point of view are on suction side of exducer blades, near the leading edge (310).

The minimum pressure value inside the second row of exducer blades strongly depends on design choices and typically is between 90% and 50% of the total inlet pressure at the second rotating compressor stage, i.e. at the leading edge (310).

The invention claimed is:

1. A compressor arranged to process a CO2 flow, comprising:

a first compressor stage comprising a first row of rotary blades with a first number of blades;

a second compressor stage comprising a second row of rotary blades with a second number of blades, the second compressor stage being fluidly connected downstream the first compressor stage, wherein the first number of blades is less than the second number of blades, wherein the first stage is arranged to provide at outlet the CO2 flow in supercritical condition, wherein the first row of rotary inducer blades is arranged to provide the CO2 flow directly to the second row of blades, wherein the second row of blades is axially spaced from the first row of blades to form an annular gap between the first row of blades and the second row of blades, and wherein the annular gap is empty space that does not have features that contact the CO2 flow from the first stage to the second stage, and wherein the annular gap has an axial length between one and two times a trailing edge height of the first row of blades.

2. The compressor of claim 1, wherein a pressure ratio of the first compressor stage is smaller than the pressure ratio of the second compressor stage.

3. The compressor of claim 1, wherein a pressure ratio of the first compressor stage is more than 1.0 and less than 1.2.

4. The compressor of claim 1, wherein a ratio between the second number of blades and the first number of blades is a number higher than 1 and lower than 2 or higher than 2 and lower than 3.

5. The compressor of claim 1, further comprising:

inlet guide vanes upstream of the first row of blades.

6. The compressor of claim 1, wherein the first row of blades have mainly axial development.

7. The compressor of claim 1, further comprising:

a first rotor and a second rotor, wherein the first row of blades is part of the first rotor and the second row of blades is part of the second rotor.

8. The compressor of claim 1, further comprising:

a rotor, wherein the first row of blades and the second row of blades are parts of the rotor.

9. An energy generation system based on a supercritical CO2 cycle, comprising:

two heat exchangers;

an expander; and a compressor according to claim 1.

* * * * *